United States Patent [19]

Cook et al.

[11] 4,394,108

[45] Jul. 19, 1983

[54] FRONT LOADER VEHICLE WITH TELESCOPING BOOM

[75] Inventors: Richard J. Cook, Hayti; Richard Reade, Caruthersville, both of Mo.

[73] Assignee: Mid-Continent Aircraft Corporation, Hayti, Mo.

[21] Appl. No.: 862,972

[22] Filed: Dec. 21, 1977

[51] Int. Cl.[3] ..... B66C 23/04

[52] U.S. Cl. ..... 414/680; 414/403; 414/718; 414/728; 212/261; 212/269

[58] Field of Search ..... 214/130 R, 130 B, 41 R, 214/146.5, 77 R, 301, 302, 304, 141, 131 R, 138 R, 138 C, 138 D, 138 E, 138 F, 138 G; 222/164, 167, 556, 608; 298/17 B, 27, 24; 212/141, 9, 140, 55

[56] References Cited

U.S. PATENT DOCUMENTS

| | | | |
|---|---|---|---|
| 3,591,016 | 7/1971 | Hanada | 212/55 |
| 3,605,561 | 9/1971 | Lado | 212/55 X |
| 3,813,124 | 5/1974 | Roland | 298/17 B |
| 3,836,025 | 9/1974 | Olson | 214/77 R |
| 3,913,756 | 10/1975 | Barron | 214/141 X |

FOREIGN PATENT DOCUMENTS

| | | | |
|---|---|---|---|
| 1506953 | 10/1969 | Fed. Rep. of Germany | 214/141 |
| 2100603 | 7/1971 | Fed. Rep. of Germany | 212/141 |
| 686858 | 7/1930 | France | 414/345 |
| 620649 | 3/1949 | United Kingdom | 414/680 |
| 825441 | 12/1959 | United Kingdom | 414/680 |
| 871100 | 6/1961 | United Kingdom | 414/680 |
| 1187527 | 4/1970 | United Kingdom | 414/680 |
| 1207610 | 10/1970 | United Kingdom | 414/680 |
| 1340810 | 12/1973 | United Kingdom | 414/680 |

*Primary Examiner*—Douglas C. Butler
*Assistant Examiner*—Donald W. Underwood
*Attorney, Agent, or Firm*—LeBlanc, Nolan, Shur & Nies

[57] ABSTRACT

A truck vehicle carried boom system for lifting, transporting, and depositing a load of particulate material such as powder, granules or seeds into storage bins in material dispensing aircraft, including a telescoping boom structure pivotally mounted on support structure which in turn is rigidly secured to the vehicle frame. The boom includes provision for removable carrying a hopper form of load bag. An extensible piston-cylinder hydraulic motor is utilized to obtain various pivotal positions of the boom. The boom telescope disposition is maintained by a mechanical safety pin. The boom is extended and retracted by inertial forces generated by vehicle manipulation. As an auxiliary device a boom safety bar, hydraulically operated is secured to a side portion of the truck bumper structure to provide a safety block when the boom is in the aircraft loading position.

9 Claims, 7 Drawing Figures

FIG. 1
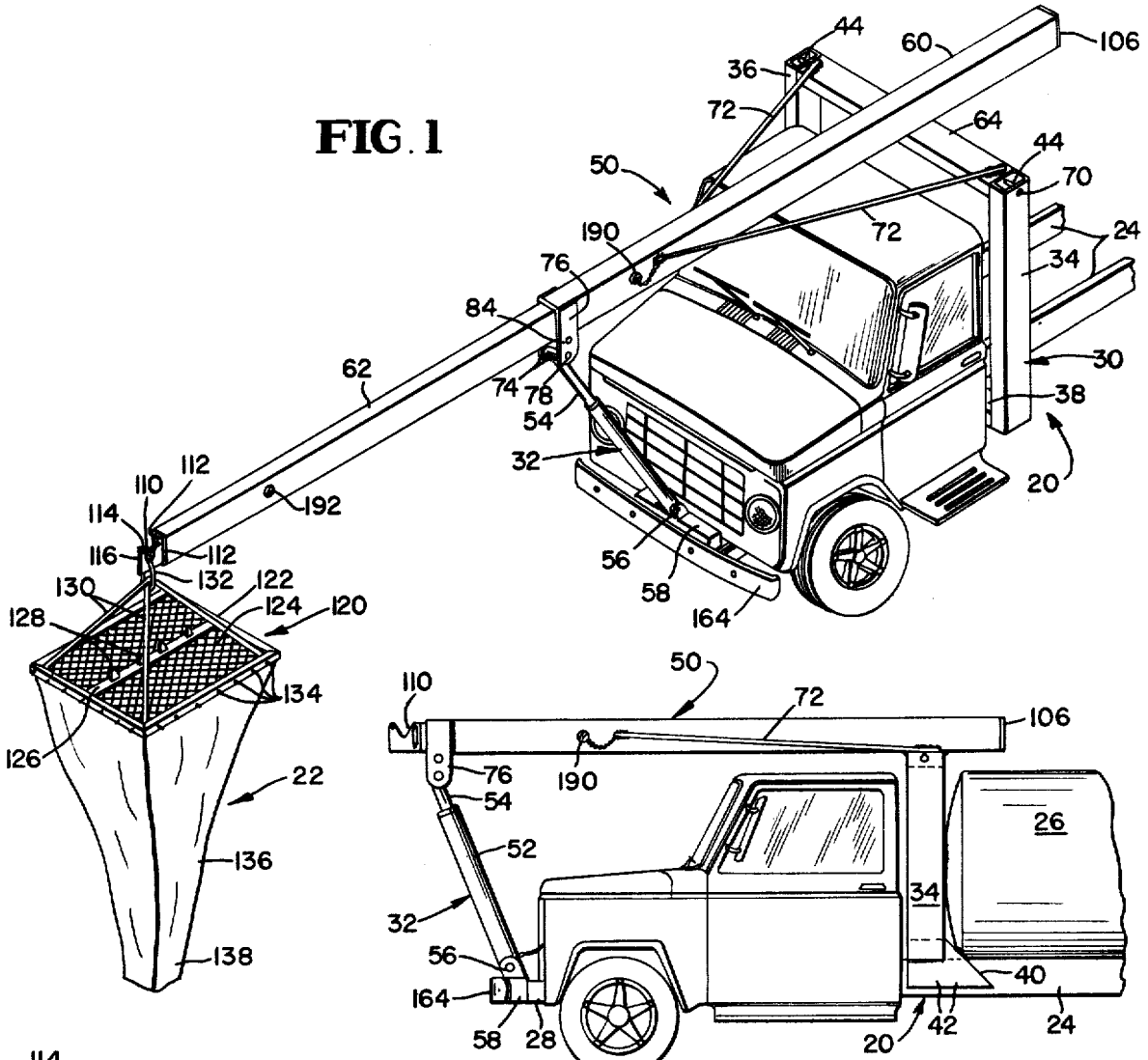
FIG. 2
FIG. 3
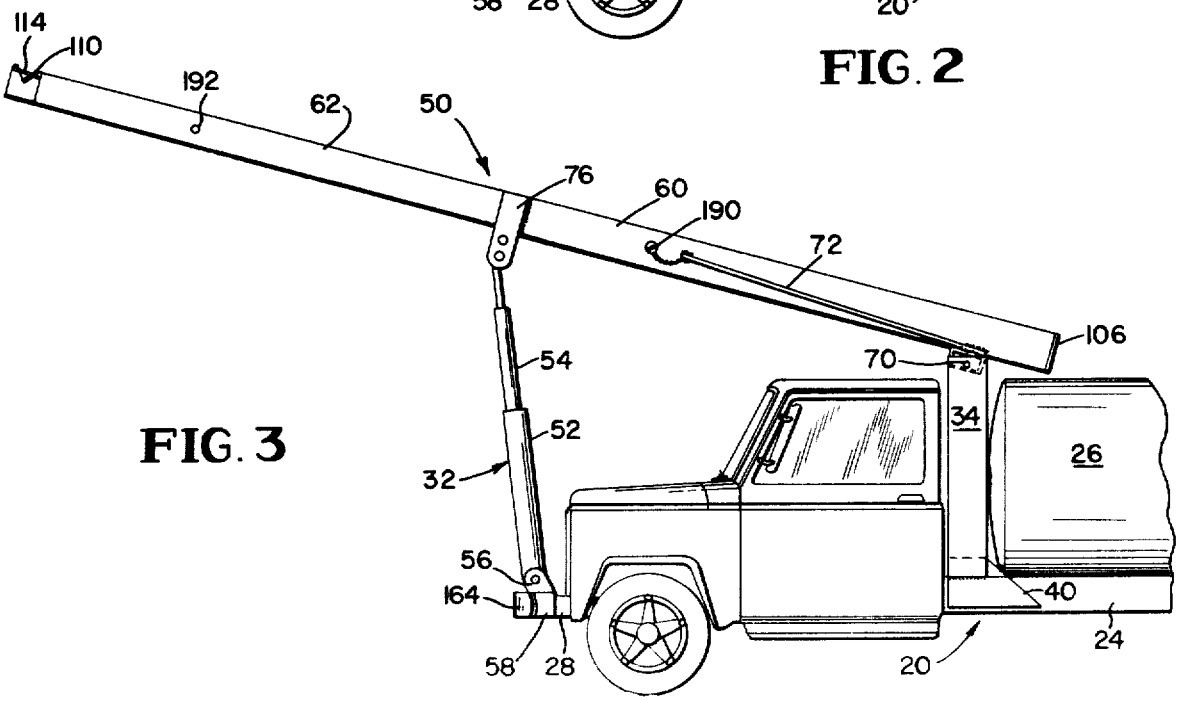

FRONT LOADER VEHICLE WITH TELESCOPING BOOM

BACKGROUND OF THE INVENTION

The present invention relates to improvements in truck type vehicles which include a front end telescoping boom which can removably carry a dispensing hopper like container to enable lifting, transporting, and depositing loads of particulate material into dusting or particulate material dispensing aircraft. While the idea of front loader vehicle using a box frame front end boom with pivotally carried hopper has been previously used, it has become desirable to provide a somewhat smaller and more compact boom installation for use when the quantity and weight of the material being loaded is not great enough to justify use of the larger and heavier front loader. This present invention provides such a compact installation.

A co-pending application Ser. No. 854,683, filed Nov. 25, 1977, illustrates an improved version of a prior art aircraft front loader with a box beam carrying a fixed hopper.

While the prior art does teach use of a telescoped single boom on a vehicle for lifting articles and with the boom being elevated by a hydraulic cylinder, see for example, Grove U.S. Pat. No. 3,809,180; Lambert U.S. Pat. No. 3,874,526, Johnson et al U.S. Pat. No. 4,027,801; and Brown U.S. Pat. No. 4,049,238; none of that art teaches a forward extended boom on a front loader with the rear end of the boom secured to a cross arm located to the rear of a vehicle cab, the cross arm being pivotally supported on the upper ends of laterally spaced upright beams, and with a hydraulic elevating operator attached to the boom and to the vehicle at the front end of the vehicle.

The present invention involves an installation on a truck vehicle which results in an aircraft front loader vehicle with a single forward projecting telescoping beam which can be securely installed on the frame of the vehicle with the beam projecting forward and with provisions for extending, retracting and raising the beam. A hook device at the front end of the beam is used to carry a suspended dispensing bag in the form of a hopper. A hydraulic safety device is included to provide a safety blocking abutment under the beam when it is in various raised positions.

SUMMARY OF THE INVENTION

It is an object of the present invention to provide a construction which enables a forwardly projecting single boom to be conveniently pivotally mounted adjacent its rear end on a truck to the rear of the truck cab and supplemented by a piston and cylinder motor link assembly to be utilized, in a double acting manner to raise and lower the boom to position the front end of the boom and a material dispensing container carried by the boom in a proper and secure position for loading material into a dusting airplane.

In conjunction with the foregoing object it is also an object of the present invention to provide a structure for maintaining the boom in its loading position which includes a safety brace device which will prevent inadvertent boom lowering due to a failure of the hydraulic system.

In such a single boom front loader a further object resides in providing a telescoping construction for the single beam to enable extension of the boom when undertaking a loading operation and retraction for stowing when the vehicle is in transit. The telescoping boom is constructed for free telescoping action on an internal roller support arrangement and includes provision for use of a locking pin in extended and retracted positions.

In combination with the above objects of invention a further object resides in the provision of a simple material dispensing container which is a hopper shaped bag with a rigid, framed upper, open end and converging to a lower flexible conduit like dispensing end which can be suitably closed until dispensing is desired. The bag includes a sling arrangement by which it can be hung on a fixed hook at the end of the front loader boom.

Further novel features and other objects of this invention will become apparent from the following detailed description, discussion, and the appended claims taken in conjunction with the accompanying drawings.

BRIEF DESCRIPTION OF DRAWINGS

A preferred structural embodiment of this invention is disclosed in the accompanying drawings in which:

FIG. 1 is a perspective view illustrating the front loader vehicle with the rear portion of the vehicle broken away to illustrate the side rails of the vehicle frame;

FIG. 2 is a side view of the front loader shown in FIG. 1, illustrating the position of the boom in its stored position; the rear portion of the truck being deleted;

FIG. 3 is a side view similar to FIG. 2 but illustrating the telescoping boom being extended and raised to an aircraft loading position;

GENERAL DESCRIPTION

Figure 4:
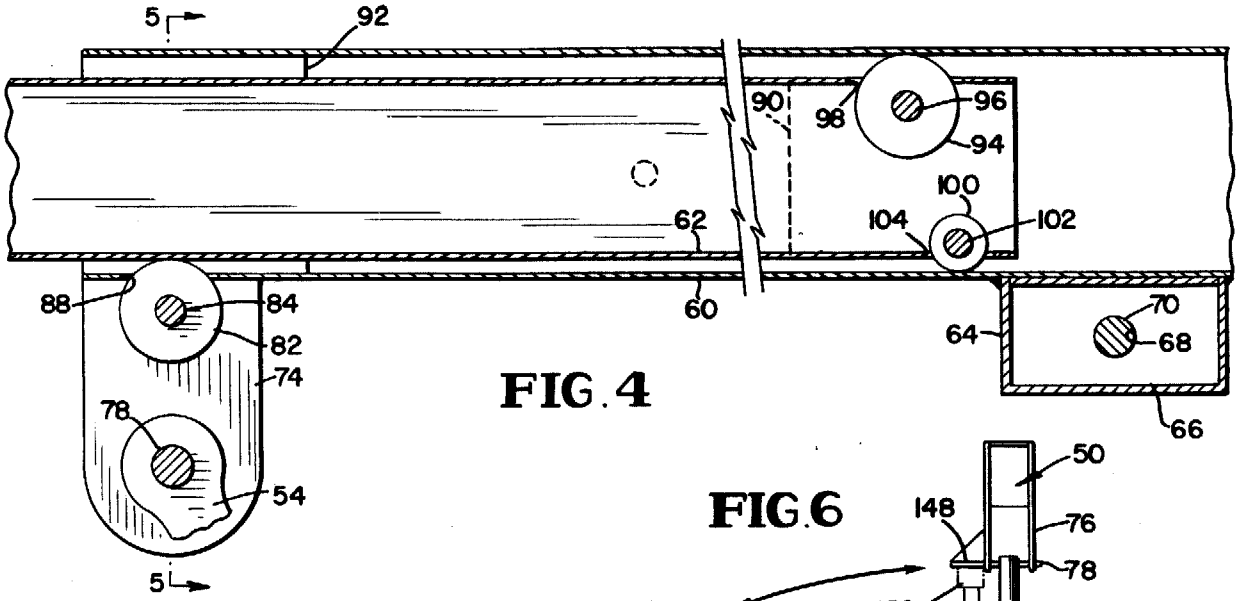
FIG. 4 is an enlarged cross-section detail view of the telescoping boom to illustrate the roller arrangement which enables ease of telescoping action of the boom sections for extension and retraction.

With reference to the drawings, particularly FIGS. 1, 2 and 3, there is illustrated a flat bed truck 20 upon which the front loading structure, carrying a discharge hopper shaped bag 22, is assembled to provide the complete aircraft front loader. The truck 20 has a main frame with side rails 24 which carry the truck bed or, as illustrated, a tank 26 and forward frame rails 28 to which the truck front bumper is normally secured. Truck 20 is illustrated with tank 26 fastened to the frame rails 24 inasmuch as such a truck carried tank is often used for loading liquids into material dispensing aircraft and the truck can be conveniently utilized as the vehicle portion of the described front loader. The complete tank and liquid dispensing aspects per se do not constitute a part of the present invention and are not disclosed in detail.

The supporting structure to which the hopper boom is pivotally secured to the truck 20 includes a rear mounted U-frame 30 and the front mounted hydraulic motor 32. Rear frame 30 is constructed from three heavy steel box beams, two vertical side beams 34 and 36 and a bottom or base cross beam 38, the three beams being welded together as a unit. The base 38 of the U-frame 30 is mounted laterally across the truck frame side rails just to the rear of the truck cab, with the upright side beams 34 and 38 projecting several inches above the top of the truck cab. Two heavy steel rear frame attachment plates 40 are welded to the base 38 so they straddle the truck side rails 24 and they are rigidly secured to the webs of side rails 24 by a plurality of bolts 42. If the truck 20 includes a tank 26, the vertical beams 34 and 36 can abut and be welded to the front end of the tank for extra support. In the absence of the tank, diagonal brace (not shown) can be secured between the vertical U-frame beams and the truck frame rails, if desired.

The heavy U-frame 30 provides a rigid structure for pivotally supporting the rear end of a telescoping boom 50, described in detail hereinafter, and for that purpose a journal sleeve 44 is placed through side apertures in the upper end of each of the vertical side beams 34 and 36.

Figure 7:
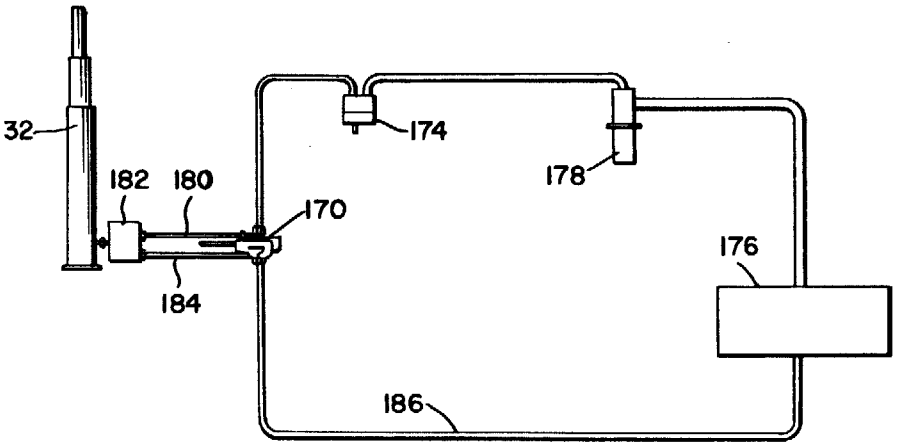
FIG. 7 is a schematic diagram of a hydraulic system which can be used to power and operate the boom elevating motor.

The piston-cylinder motor is a double acting telescoping hydraulic motor with connecting eyes at the lower end of the cylinder 52 and at the extensible end of the piston rod 54. Motor 32 has its cylinder eye mounted in a fork pivot connection 56 and secured by conventional pivot pin. The fork connection 56 is part of the cylinder attachment bracket 58 which is welded or bolted to the front truck frame rails 28 or to the bumper brackets. The hydraulic motor is operated and controlled in a conventional manner by a fluid pressure system such as shown in FIG. 7 and which will be briefly described hereinafter.

Figure 5:
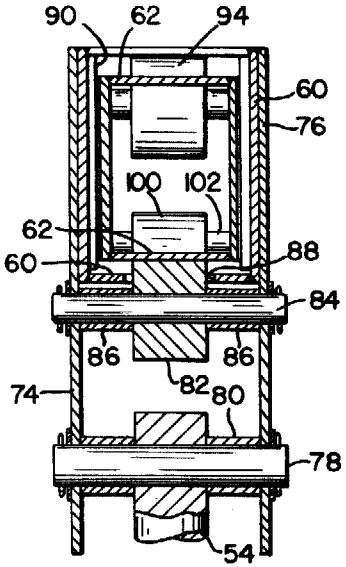
FIG. 5 is a section view taken on line 5—5 of FIG. 4 to illustrate details of the telescoping boom beams.

With reference to FIGS. 1, 4 and 5 the telescoping boom 50 includes three box beams, two 60,62 of which telescope and the third being a rear cross arm 64 secured to the outer beam 60 near the rear of the boom assembly and pivoted between the upright beams of the rear U-frame. Cross beam 64 is disposed transverse to and is welded to the under side of boom beam 60 near its rear end and fits between the two journal sleeves 44 in the upper ends of the U-frame side beams. Welded to each end of the cross-beam is a steel cap plate 66 apertured at 68 to receive an elongate pivot rod 70, which extends through the cross beam and through each side beam journal sleeve 44 to provide a pivot axle for the boom. Clips or cotter pins in each end of the rod 70 secure it in position. Two diagonal bracing rods 72 are fastened as by welding between the cross beam 64 and boom 60.

Welded on each side of the forward terminal end of boom 60 is a heavy steel plate 74,76 which provide a depending fork fitting to which the connecting eye at the terminal end of motor piston 54 is connected by a conventional pivot pin 78 and spacer sleeves 80 (FIG. 5).

Above the pivot mounting of the motor piston the fork plates 74 and 76 also serve to mount a large steel roller 82 rotatably secured on an axle pin 84 extending through suitable apertures in the plates 74 and 76, spacers 86 and secured by washers and clips or cotter pins. Roller 82 is disposed so it partially projects up through an opening 88 and abuts the underside of the inner boom beam 62, and supports the inner beam 62 in spaced relationship away from engagement with the inner lower surface of the outer beam 60.

On each side at the rear end of the inner boom beam 62 a steel strengthening and abutment plate 90 is secured as by welding. The dimension between the outer surfaces of the abutment plates 90 is slightly less than the lateral inside dimension of outer beam 60 to permit a free sliding fit. Similar strengthening and abutment plates 92 are welded to the inside side walls of the outer boom beam at the front end. When the inner boom 62 is fully extended the plates 90 abut plates 92 to provide a limit stop to the full extended condition.

A large steel roller 94, similar to roller 82, is rotatably mounted adjacent the top of the rear end of inner boom beam 62 on an axle pin 96 which can be pressed into apertures through the beam 62 and the abutment plates 90. Roller 94 is disposed so it partially projects up through an opening 98 in the top wall of beam 62 and bears against the inside top surface of the outer boom 60. A smaller idle roller 100 is similarly rotatably mounted on an axle pin 102 below the roller 94 and is disposed to project through a lower opening 104 in the inner beam and engage the lower wall surface of the outer beam 60. The inner beam 62 can telescope within the outer beam on rollers 82, 94 and 100 with the large rollers 82 and 94 constituting load bearing rollers and the smaller roller 100 cooperating with the forward roller 82 to maintain the bottom surface of the inner beam spaced above the inner lower surface of the outer beam. The inner beam 62 can be assembled into the outer beam 60 from the rear end and a steel end cap plate 106 welded to the rear end of the outer beam 60. Cap 106 can serve as the limit stop for the retracted condition of the telescoping boom.

At the front end of the inner boom beam is a rather simple hook 110. Hook 110 is fabricated from steel plate and, with side plates 112, inserted into the front end of beam 62 and rigidly fastened by bolts or welding.

When the boom elevation motor is in its retracted position, FIG. 2, the boom is located essentially horizontal above the truck cab with the boom projected sufficiently so the boom hook 110 is disposed in a location extended forward of the truck a distance enabling hanging a material dispensing bag 22 on the hook 110 without interference between the bag unit 22 and the truck. The dispensing bag unit 22 is kept simple and includes an upper inlet frame 120 which can be a rectangular frame of bar stock 122 to which is fastened a screen 124 and a cross bar 126 with upstanding bag rupturing blades 128. Rods 130 welded to each corner of frame 120 converge to join and thereat are welded to a U-bail 132 which serves as a hanger by which the dispensing bag assembly can be hung on the boom hook 110. A plurality of pins 134 project outwardly in spaced apart relationship along the frame bars 122 and cooperate with suitably reinforced (grommets or stitching) apertures along the upper border of a hopper shaped fabric bag 136 which converges from a top reinforced edge matching the square shape of frame 120 down to a lower tubular discharge end 138. Before the bag 136 is filled with material to be loaded into an aircraft, the lower tubular end 138 is folded and tied with rope or other suitable lashing.

Figure 6:
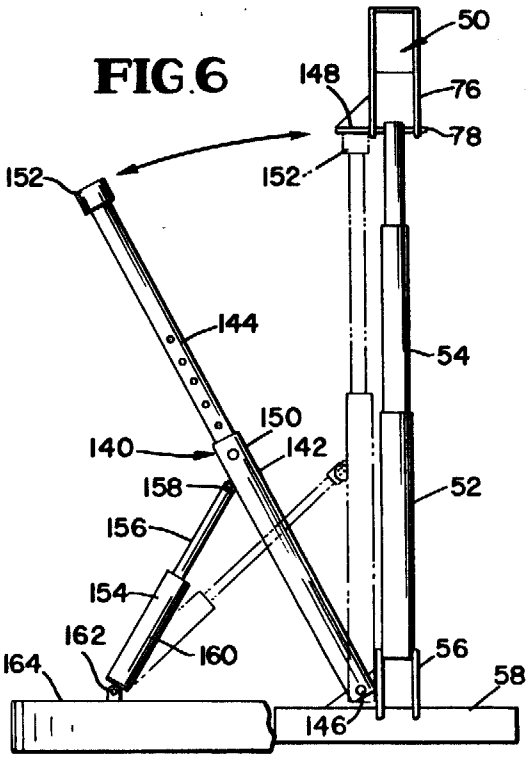
FIG. 6 is a detail front view of an optional, hydraulically shifted safety bar assembly attached to the front bumper adjacent the boom elevating hydraulic motor.

A safety bar assembly 140 can be installed on the front end of the vehicle as shown in FIG. 6 and can be hydraulically shifted into and out of a boom blocking disposition when the boom is raised for transport or is in an aircraft loading position. The safety bar 140 is made from two telescoping steel tubes 142 and 144 which make an extensible beam that can be adjusted to various desired lengths and retained in adjusted length by a pin 150 through matching holes, in a well known manner. The lower end of the safety bar 140 is pivotally mounted on a pivot pin bracket 146 welded or otherwise fixed to the main cylinder fork fitting 56, and can be laterally swung from a inoperative disposition (full lines) to a blocking position (phantom lines) where the end of the safety bar 140 will be disposed under a gusset like abutment 148 welded or otherwise secured to the side of the outermost boom member 60 near its forward end. An abutment cap 152 is secured on the end of safety bar tube 144 and in safety position will be directly under and engaged by the gusset abutment 148 to limit the downward movement of the loader boom 50.

The safety bar 140 can be laterally swung into and and away from safety blocking position by a double acting hydraulic piston-cylinder motor 154 connected between the safety bar and the vehicle front frame structure. As shown in FIG. 6, the mounting eye of the motor cylinder 160 is pivotally mounted to a fork fitting 162 fastened on the vehicle front bumper 164. The eye fitting of the extensible motor piston 156 is pivotally secured to a pivot fitting 158 secured to the outer tube 142 of the safety bar. Via suitable vehicle hydraulic controls (not shown) safety bar motor can be operated to swing the bar 140 into and away from a boom blocking disposition.

The normal truck mounted hydraulic system can be utilized with conventional controls to furnish pressure for operating the boom lifting motor 32 as well as to control the safety bar motor 154. A simple hydraulic circuit shown in FIG. 7 includes the pump 174, oil system sump or reservoir 176, a filter 178, control valve 170, and system return line 186. Various lines 180, 184 and system check valves 182 can be connected from the control valve 170 to a hydraulic motor 32 to provide desired operative control. The hydraulic system and controls are conventional and can be modified in various ways to suit a specific installation.

OPERATION

The aircraft loader truck 20 is moved to a loading station at which point the boom 50 will be extended. To extend the boom, a safety pin 190 is first removed from interlocking engagement through holes (see 192 in FIG. 1) in the two telescoped beams 60 and 62. The truck is driven forward at low speed (e.g., 15 mph.) and stopped abruptly by braking. The boom extends to its fully extended condition under inertia (see FIG. 1) at which location the safety pin 190 is reinserted in the inner beam. A small retainer bar 114 pivoted above the mouth of boom hook 110 is retained by a safety pin 116. The pin 116 is removed, bag unit 22 is hung on the hook 110 and safety bar 114 latched by pin 116. The bag unit 22 can now be loaded, if it was not pre-loaded, by tossing bags of the material to be dispensed on top of the screen 124 and the bag rupturing blades 128.

The boom can then be raised to an intermediate position for transport. The safety bar assembly 140 can be moved back to a blocking position so that inadvertent lowering of the boom will not occur. Similarly the safety bar assembly should be shifted to its safety blocking location (FIG. 6) whenever the truck and hopper are moved to adjacent an aircraft for a filling operation. Dumping of material into the aircraft is done manually by an operator who removes the rope or lashing from the bag discharge tubular end 138 and material flows from the bag into the aircraft.

The truck is removed from the aircraft and the bag unit removed. To retract the boom, it is placed in the fully raised position with the safety restraining pin 190 is removed. The truck is moved backwards at slow speed and abruptly braked. The boom will rapidly telescope to retracted position under inertia. The restraining pin 190 should then be replaced and the boom can be lowered by manipulation of the control valve 170 to the retracted position seen in FIG. 2.

The support framework and boom construction can be tailored to and installed on a specific truck or can be furnished as an installation kit. In either case it is preferred that the boom and support framework be made from structural steel.

The invention may be embodied in other specific forms without departing from the scope, spirit, or essential characteristics thereof. The present embodiment is, therefore, to be considered in all respects as illustrative and not restrictive, the scope and spirit of the invention being indicated by the appended claims rather than by the foregoing description and all changes which come within the meaning and range of equivalency of the claims are, therefore, intended to be embraced therein.

What is claimed and desired to be secured by Letters Patent is:

1. A front loader vehicle for loading particulate materials into material dispensing aircraft for uses such as seeding, crop dusting, fire fighting, and forest defoliation, comprising: a truck vehicle having integral frame structure with front and rear frame portions; a front and a rear boom support means respectively secured to said front and rear frame portions; a telescoping boom structure; means pivotally mounting the rear end of said boom structure to the rear boom support means to permit elevation of said boom from a horizontal stowed position with the boom structure projected forward over the truck to an elevated position extending upward and forward of the truck; said front boom support means comprising an extensible power operated motor connected between the boom and the front truck frame portions; controls for said motor for pivoting the boom structure between the stowed and elevated positions; said boom structure having at least two telescoping elongate members, the innermost elongate member being slidable from a fully retracted position to an extended position within the outermost elongate member; means to interlock said elongate members at least in a stowed and extended interrelationship; means on the front end of the innermost elongate member for carrying a material dispensing container; an external abutment means on said boom structure adjacent the front end of the outermost elongate member; a boom position safety bar comprising an upright elongate extensible beam with pivot means at its lower end and means at its upper end adapted to be located under said abutment means on said boom; a pivot connector on said vehicle front frame connected to said safety bar pivot means enabling lateral swinging of said safety bar from a position out of engagement with said boom structure to a blocking position in engagement with said boom structure which prevents downward movement of said boom structure; and power means for swinging said safety bar between its two positions including a double acting, hydraulic piston-cylinder connected between said safety bar and said vehicle front frame means.

2. A front loader vehicle for loading particulate materials into material dispensing aircraft for uses such as seeding, crop dusting, fire fighting, and forest defoliation, comprising: a truck vehicle having integral frame structure with front and rear frame portions; a front and a rear boom support means respectively secured to said front and rear frame portions; a telescoping boom structure; means pivotally mounting the rear end of said boom structure to the rear boom support means to permit elevation of said boom from a horizontal stowed position with the boom structure projected forward over the truck to an elevated position extending upward and forward of the truck; said front boom support means comprising an extensible power operated motor connected between the boom and the front truck frame portions; controls for said motor for pivoting the boom structure between the stowed and elevated positions; said boom structure having at least two telescoping elongate members, the innermost elongate member being slidable from a fully retracted position to an extended position within the outermost elongate member; means to interlock said elongate members at least in a stowed and extended inter-relationship; means on the front end of the innermost elongate member for carrying a material dispensing container; and a material dispensing container comprising a rigid top open frame with a suspension sling connected thereto; and mounted on said boom structure carrying means, a hopper shaped fabric bag with an open top end and convergent to a tubular lower end, and means on said frame and said bag secure the upper periphery of said bag to the periphery of said open frame.

3. A front loader vehicle for loading particulate materials into material dispensing aircraft for uses such as seeding, crop dusting, fire fighting, and forest defoliation, comprising: a conventional truck vehicle with a cab and engine in front having integral frame structure with front portions extending forward of said cab and engine and rear portions extending rearward of said cab and engine; a front and a rear boom support means respectively secured to said front and rear frame portions; said rear boom support means extending up behind the cab; a telescoping boom structure; means pivotally mounting the rear end of said boom structure to the upper portion of the rear boom support means to permit changing elevation of said boom between a horizontal stowed position where the boom structure is above the cab and projected forward over the front end of truck and an elevated position extending upward and forward of the truck; said front boom support means comprising an extensible power operated motor connected between the boom and the front truck frame portions; controls for said motor for pivoting the boom structure between the stowed and elevated positions; said boom structure having at least two telescoping elongate members, the innermost elongate member being slidable from a fully retracted position to an extended position within the outermost elongate member; means to interlock said elongate members at least in a stowed and extended inter-relationship; means mounted on the front frame portion of said vehicle including a boom position safety bar and means enabling said bar to be swung from a position out of engagement with said boom structure to a blocking position in engagement with said boom structure which prevents downward movement of said boom structure; power means for swinging said safety bar between its two positions; and means on the front end of the innermost elongate member for carrying a material dispensing container.

4. A front loader vehicle as defined in claim 3, wherein said boom structure includes an external abutment means adjacent the front end of the outermost elongate member; said boom safety bar comprises an upright elongate extensible beam with pivot means at its lower end and means at its upper end adapted to be located under said abutment means on said boom; and a pivot connector on said vehicle front frame is connected to said safety bar pivot enabling lateral swinging of said safety bar about its lower end.

5. A front loader vehicle for loading particulate materials into material dispensing aircraft for uses such as seeding, crop dusting, fire fighting, and forest defoliation, comprising: a conventional truck vehicle with a cab and engine in front having integral frame structure with front portions extending forward of said cab and engine and rear portions extending rearward of said cab and engine; a front and a rear boom support means respectively secured to said front and rear frame portions; said rear boom support means extending up behind the cab; said rear boom support means being a U-frame fabricated from box beams welded as an integral unit, the mid-portion of said U-frame being disposed above and rigidly secured to said vehicle rear frame portions adjacent the rear of the vehicle cab; and the legs of said U-frame being disposed vertical and projected with their upper ends above the top level of the vehicle cab; journal means at the upper ends of said U-frame; a telescoping boom structure; means pivotally mounting the rear end of said boom structure to the upper portion of the rear boom support means, including a boom cross member having means pivotally supporting the cross member between and in the U-frame end journals to permit changing elevation of said boom between a horizontal stowed position where the boom structure is above the cab and projected forward over the front end of truck and an elevated position extending upward and forward of the truck; said front boom support means comprising an extensible power operated motor connected between the boom and the front truck frame portions; controls for said motor for pivoting the boom structure between the stowed and elevated positions; said boom structure having at least two telescoping elongate members, the innermost elongate member being slidable from a fully retracted position to an extended position within the outermost elongate member; means to interlock said elongate members at least in a stowed and extended inter-relationship; and means on the front end of the innermost elongate member for carrying a material dispensing container.

6. For use in a front loader vehicle which has integral frame structure with front and rear frame portions, a boom arrangement comprising: a front and a rear boom support means adapted respectively for rigid attachment to the front and rear frame portions of the vehicle; said rear boom support means being a U-frame fabricated from box beams welded as an integral unit, the mid-portion of said U-frame being adapted to be rigidly secured to the vehicle rear frame portion behind the vehicle cab; and the legs of said U-frame being disposed vertical; journal means at the upper ends of said U-frame; a telescoping boom structure; means pivotally mounting the rear end of said boom structure to the rear boom support means including a boom cross member having means pivotally supporting the cross member between and in the U-frame end journals to permit elevation of said boom about a rear pivot axis from a horizontal position with the boom structure projected forward to an elevated position extending upward and forward; said front boom support means comprising an extensible power operated motor connected to the boom and adapted to be connected to the front truck frame portions; said boom structure having at least two telescoping elongate members, the innermost elongate member being slidable from a fully retracted position to an extended position within the outermost elongate member; means to interlock said elongate members at least in fully retracted and fully extended inter-relationship; and means mounted on the front end of the innermost elongate member for carrying a material dispensing container.

7. A front loader vehicle for loading particulate materials into material dispensing aircraft for uses such as seeding, crop dusting, fire fighting, and forest defoliation, comprising: a conventional truck vehicle with a cab and engine in front having integral frame structure with front portions extending forward of said cab and engine; a front and a rear boom support means respectively secured to said front and rear frame portions; said rear boom support means includes support beam means extending up behind and higher than the cab with laterally spaced apart journal means at the upper end of said support means and with the lower end of said support beam means rigidly secured to the vehicle rear frame forward portion adjacent to and behind the vehicle cab; a telescoping boom structure comprising at least outer and inner telescoping tubes, roller means carried by both tubes enabling a free rolling coaction between said tubes, said innermost tube, when the locking means are disengaged, being unrestrained and free to roll under inertia forces between the fully retracted position and an extended limit position, and abutment means on each of said tubes adapted to provide an abutment telescopic limit engagement at the retracted position and at the extended position of the innermost tube; means pivotally mounting the rear end of said boom structure between said journal means at the upper portion of the rear boom support means to permit changing elevation of said boom between a horizontal stowed position where the boom structure is above the cab and projected forward over the front end of truck and an elevated position extending upward and forward over the front end of truck, said means pivotally mounting the rear end of the boom structure include an elongated pivot cross beam disposed normal to said boom adjacent and under the rearward portion of the outermost tube with means rigidly securing said support beam to said outermost tube; said front boom support means comprising an extensible power operated motor connected between the boom and the front truck frame portions; controls for said motor for pivoting the boom structure between the stowed and elevated positions; means to interlock said elongate members at least in a stowed and extended interrelationship; and means on the front end of the innermost elongate member for carrying a material dispensing container.

8. A front loader vehicle with boom structure as defined in claim 7, wherein said tubes and said cross beam are steel box beams.

9. For use in a front loader vehicle which has integral frame structure with front and rear frame portions, a boom arrangement comprising: a front and a rear boom support means adapted respectively for rigid attachment to the front and rear frame portions of the vehicle; a telescoping boom structure; means pivotally mounting the rear end of said boom structure to the rear boom support means to permit elevation of said boom about a rear pivot axis from a horizontal position with the boom structure projected forward to an elevated position extending upward and forward; said front boom support means comprising an extensible power operated motor connected to the boom and adapted to be connected to the front truck frame portions; said boom structure having at least two telescoping elongate members, and comprising: outer and inner tubes, roller means carried by both tubes enabling a free rolling coaction between said tubes, the innermost elongate member being slidable from a fully retracted position to an extended position within the outermost elongate member; means to interlock said elongate members at least in fully retracted and fully extended interrelationship; said innermost tube, when the locking means are disengaged, being unrestrained and free to roll under inertia forces betwen the retracted and extended limit positions; and abutment means on each of said tubes adapted to provide an abutment telescopic limit engagement at the retracted position and at the extended position of the innermost tube; said means pivotally mounting the rear end of said boom structure including an elongated pivot cross beam disposed normal to said beam adjacent and under the rearward portion of the outermost tube with means rigidly securing said support beam to said outermost tube; and means mounted on the front end of the innermost elongate member for carrying a material dispensing container.

* * * * *